US006929016B2

(12) United States Patent
Lee

(10) Patent No.: US 6,929,016 B2
(45) Date of Patent: Aug. 16, 2005

(54) INFLATABLE TENT

(76) Inventor: Swei-Yuan Lee, No. 1, Dashiue Road, Tainan (TW)

( * ) Notice: Subject to any disclaimer, the term of this patent is extended or adjusted under 35 U.S.C. 154(b) by 158 days.

(21) Appl. No.: 10/427,639

(22) Filed: May 1, 2003

(65) Prior Publication Data

US 2003/0213512 A1 Nov. 20, 2003

(30) Foreign Application Priority Data

May 16, 2002 (TW) ..... 91207229 U

(51) Int. Cl.[7] ..... E04H 15/40
(52) U.S. Cl. ..... 135/126; 52/2.11
(58) Field of Search ..... 135/126, 121, 135/87; 52/2.11, 2.18, 2.13

(56) References Cited

U.S. PATENT DOCUMENTS 2,875,771 A * 3/1959 Brewin
3,145,719 A * 8/1964 Johnson
3,840,919 A * 10/1974 Middleton
4,332,112 A * 6/1982 Hsu
4,556,391 A * 12/1985 Tardivel et al.
4,819,389 A * 4/1989 Kihn
5,205,086 A * 4/1993 Heim
5,570,544 A * 11/1996 Hale et al.
5,987,822 A * 11/1999 NcNiff et al.
6,179,367 B1 * 1/2001 Bowen

FOREIGN PATENT DOCUMENTS

| | | |
|---|---|---|
| GB | 2044315 | * 10/1980 |
| TW | 360272 | 6/1999 |
| TW | 465640 | 11/2001 |

* cited by examiner

*Primary Examiner*—James O. Hansen
(74) *Attorney, Agent, or Firm*—Alan D. Kamrath; Nikolai & Mersereau, P.A.

(57) ABSTRACT

An inflatable tent includes a canopy, an inflatable main frame, and at least one inflatable intermediate arcuate support member. The inflatable main frame includes a first inflatable arcuate support member attached to the canopy and a second inflatable arcuate support member attached to the canopy. The first inflatable arcuate support member has a first end located in a first one of four corners of the canopy and a second end located in a second one of the corners of the canopy. The second inflatable arcuate support member has a first end located in a third one of the corners of the canopy and a second end located in a fourth one of the corners of the canopy. The intermediate arcuate support member is attached to the canopy and located between the first inflatable arcuate support member and the second inflatable arcuate support member.

18 Claims, 5 Drawing Sheets

INFLATABLE TENT

BACKGROUND OF THE INVENTION

1. Field of the Invention

The present invention relates to an inflatable tent. In particular, the present invention relates to an inflatable tent that can be easily pitched and reliably fixed after pitching.

2. Description of the Related Art

Tents of various sizes and shapes, such as pup tents, umbrella tents, wall tents, pyramid tents, dome tents, and barrel vault tents, are available on the market. However, it takes a considerable time, usually longer than half an hour, to pitch a conventional tent. The users often feel exhausted after pitching. Further, the conventional tents are heavy and thus inconvenient to carry with. Further, the tents would fall when subject to strong winds and/or heavy rains if the tents are not reliably pitched.

Inflatable tents are proposed to save labor and time for pitching tents. Typical examples of inflatable tents are disclosed in, e.g., Taiwan Patent Publication Nos. 360272 and 465640. The inflatable tents can be pitched by continuously blowing air into a canopy, blowing air into a bladder-like canopy, or blowing air into a plurality of inflatable poles to support a canopy. Although a heavy frame made of wood or metal is not required for the inflatable tents, fixing of the inflatable tents is not reliable. Namely, the inflatable tents fall easier than the conventional tents when subject to strong winds and/or heavy rains.

SUMMARY OF THE INVENTION

An object of the present invention is to provide an inflatable tent that can be easily pitched and reliably fixed after pitching.

An inflatable tent in accordance with the present invention includes a canopy, an inflatable main frame, and at least one inflatable intermediate arcuate support member. The inflatable main frame includes a first inflatable arcuate support member attached to the canopy and a second inflatable arcuate support member attached to the canopy. The first inflatable arcuate support member has a first end located in a first one of four corners of the canopy and a second end located in a second one of the corners of the canopy. The second inflatable arcuate support member has a first end located in a third one of the corners of the canopy and a second end located in a fourth one of the corners of the canopy. The intermediate arcuate support member is attached to the canopy and located between the first inflatable arcuate support member and the second inflatable arcuate support member.

In an embodiment of the invention, the first end and the second end of the first inflatable arcuate support member are located in a front side of the canopy, and the first end and the second end of the second inflatable arcuate support member are located in a rear side of the canopy. The intermediate arcuate support member extends on a plane parallel to the front side and the rear side of the canopy. An inflatable support beam is attached to a top of the canopy and has a first end communicated with a vertex of the first inflatable arcuate support member and a second end communicated with a vertex of the second inflatable arcuate support member. Two inflatable lateral support beams are attached to two lateral sides of the canopy. Each inflatable lateral support beam has a first end communicated with the first inflatable arcuate support member and a second end communicated with the second arcuate support member. Two lower beams are attached to lower edges of two lateral sides of the canopy. Each lower beam has a first end communicated with the first inflatable arcuate support member and a second end communicated with the second inflatable arcuate support member.

In another embodiment of the invention, the first inflatable arcuate support member and the second inflatable arcuate support member are crossed with each other. The inflatable tent includes two inflatable intermediate arcuate support members that are crossed with each other. The first inflatable arcuate support member, the second inflatable arcuate support member, and the inflatable intermediate arcuate support members meet at a common top point. The first inflatable arcuate support member, the second inflatable arcuate support member, and the inflatable intermediate arcuate support members are spaced apart at regular angular intervals.

An inflatable mattress may be mounted to a ground inside the canopy. The inflatable mattress has a periphery connected to a lower periphery of the canopy.

The canopy can be quickly and reliably pitched and fixed, preventing the disadvantage of easy falling when subject to strong winds and/or heavy rains.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
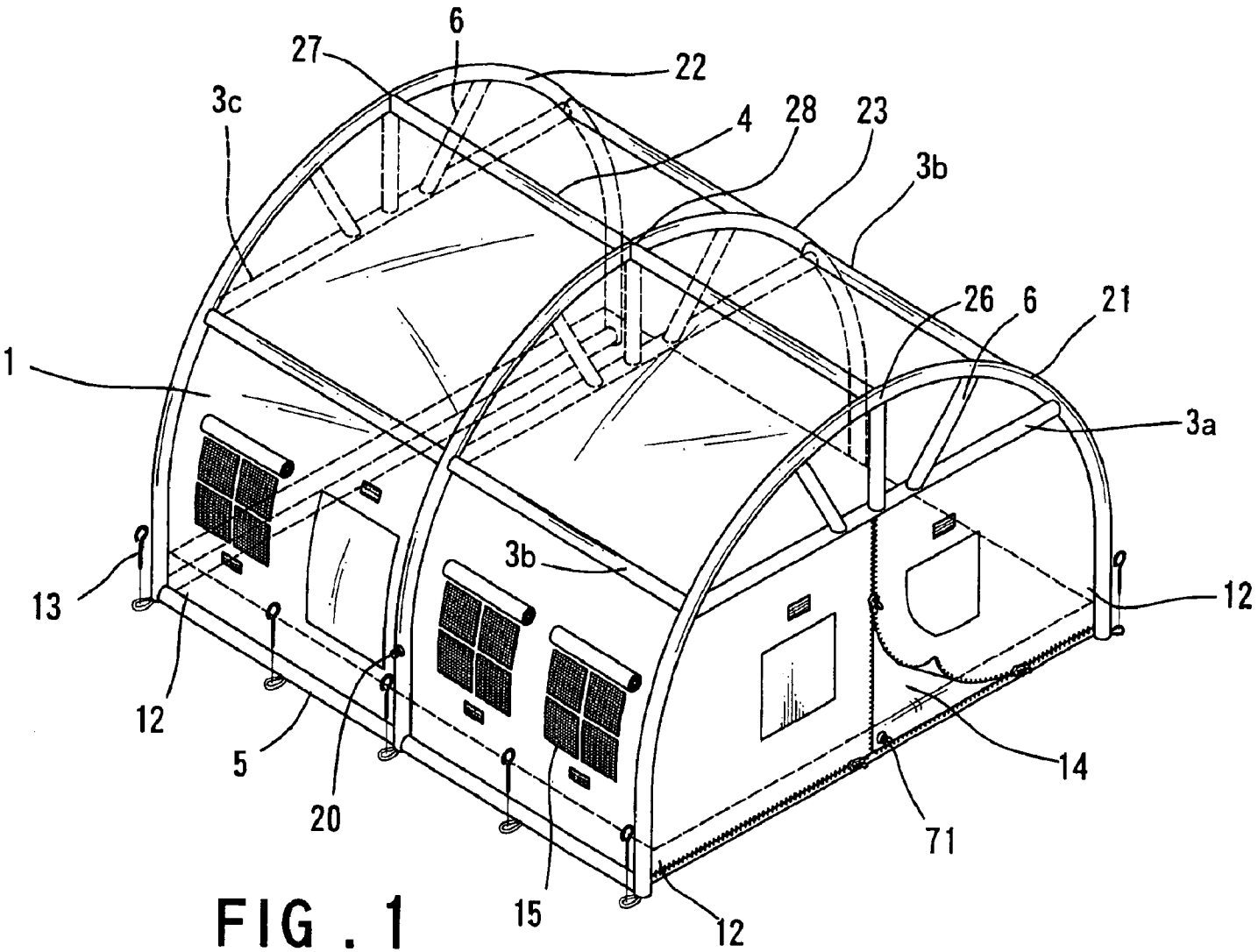
FIG. 1 is a perspective view of a first embodiment of an inflatable tent in accordance with the present invention.
Figure 2:
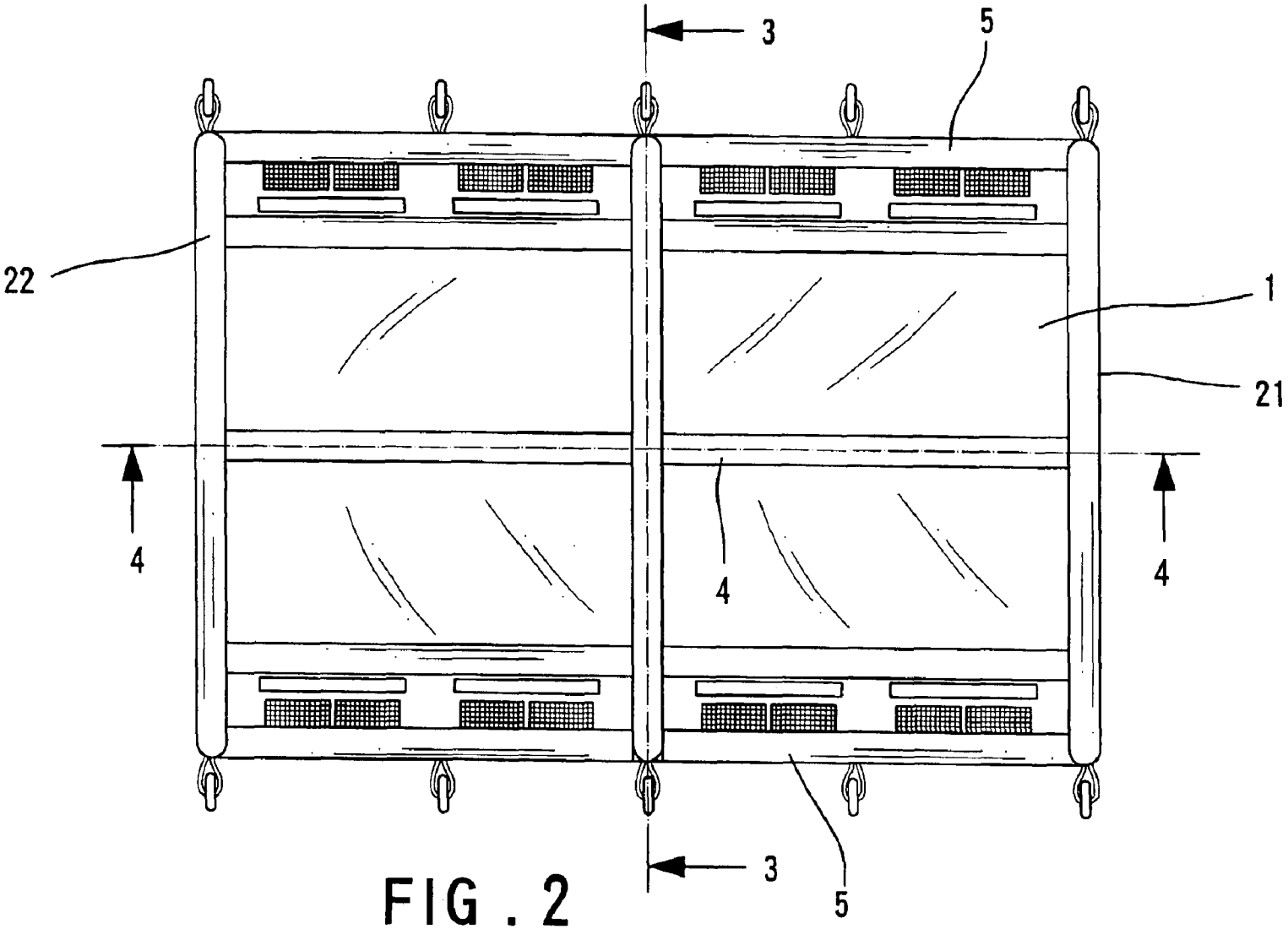
FIG. 2 is a top view of the inflatable tent in FIG. 1.
Figure 3:
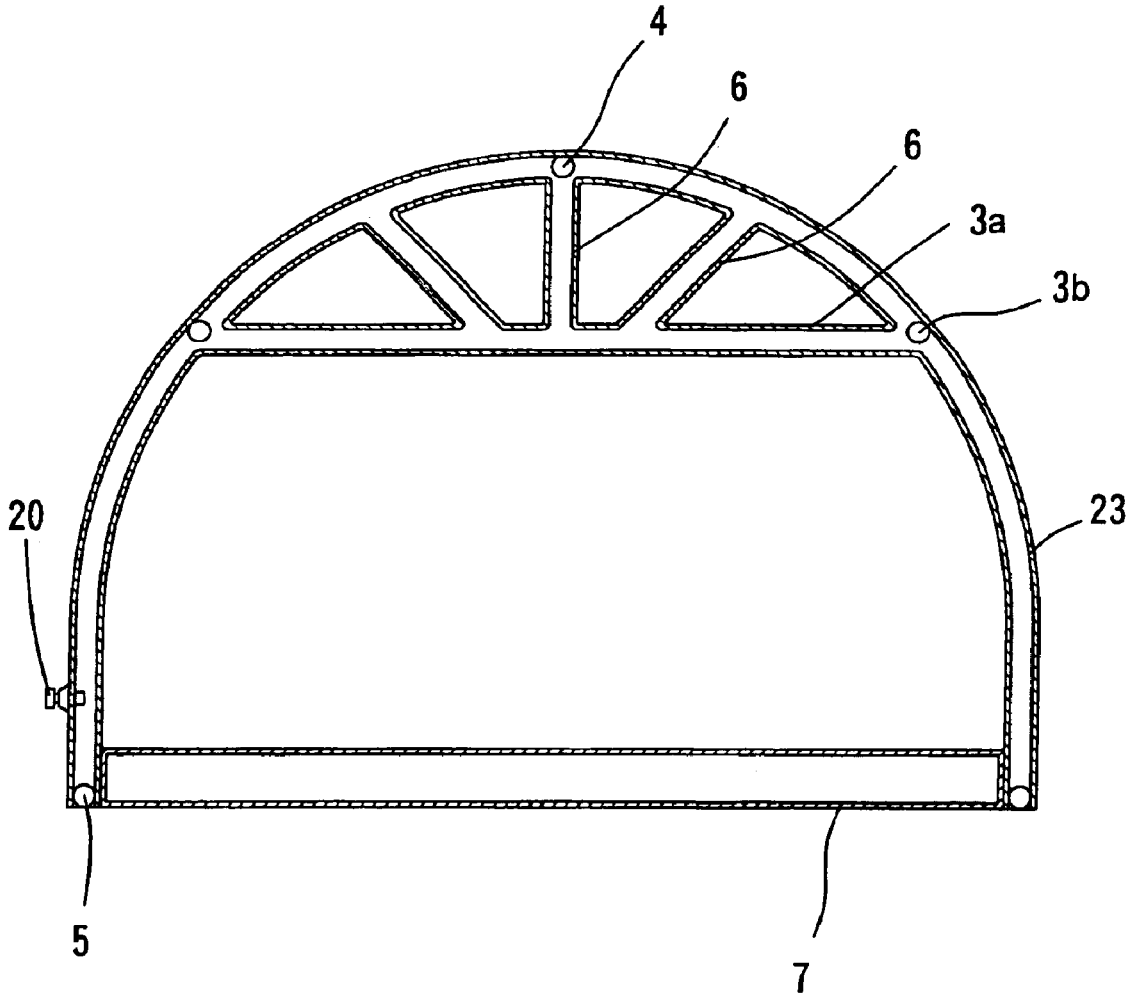
FIG. 3 is a sectional view taken along line 3—3 in FIG. 2.

FIGS. 1 through 4 illustrate a first embodiment of an inflatable tent in accordance with the present invention. The inflatable tent in accordance with the present invention includes a canopy 1 having four corners 12 and an inflatable main frame. In this embodiment, the inflatable main frame includes first and second inflatable arcuate support members 21 and 22 respectively attached to front and rear sides of the canopy 1. The first inflatable arcuate support member 21 has a first end located in a first one of the four corners 12 of the canopy 1 and a second end located in a second one of the four corners 12 of the canopy 1, wherein the first and second corners 12 of the canopy 1 are located on the front side of the canopy 1. The second inflatable arcuate support member 22 has a first end located in a third one of the four corners 12 of the canopy 1 and a second end located in a fourth one of the four corners 12 of the canopy 1, wherein the third and fourth corners 12 of the canopy 1 are located on the rear side of the canopy 1.

An inflatable intermediate arcuate support member 23 is attached to an intermediate portion of the canopy 1 and extends on a plane parallel to the front and rear sides of the canopy 1. An inflatable front support beam 3*a* is attached to the front side of the canopy 1, with two ends of the inflatable front support beam 3*a* respectively attached to two points of the first inflatable arcuate support member 21. A plurality of inflatable reinforcing support beams 6 are attached to the front side of the canopy 1 and located between the first inflatable arcuate support member 21 and the inflatable front support beam 3*a*. Preferably, an upper end of each inflatable reinforcing support beam 6 is communicated with an arcuate top portion of the first inflatable arcuate support member 21. Similarly, an inflatable rear support beam 3*c* is attached to the rear side of the canopy 1, with two ends of the inflatable rear support beam 3*c* respectively attached to two points of the second inflatable arcuate support member 22. A plurality of inflatable reinforcing support beams 6 are attached to the rear side of the canopy 1 and located between the second inflatable arcuate support member 22 and the inflatable rear support beam 3*c*. Preferably, an upper end of each inflatable reinforcing support beam 6 is communicated with an arcuate top portion of the second inflatable arcuate support member 22. Further, two inflatable lateral support beams 3*b* are attached to two lateral sides of the canopy 1, with two ends of each lateral support beam 3*b* respectively attached to the first inflatable arcuate support member 21 and the second inflatable arcuate support member 22. Preferably, an end of each inflatable lateral support beam 3*b* is communicated with an end of the inflatable front support beam 3*a* and the first inflatable arcuate support member 21, and the other end of each inflatable lateral support beam 3*b* is communicated with an end of the inflatable rear support beam 3*b* and the second inflatable arcuate support member 22. Preferably, each inflatable lateral support beam 3*b* is communicated with the inflatable intermediate support member 23 at a middle portion thereof.

A plurality of inflatable lower beams 5 are attached to the lower periphery of the canopy 1, and an inflatable top beam 4 is attached to a top of the canopy 1. In this embodiment, two lower beams 5 are attached to lower edges of the lateral sides of the canopy 1, with two ends of each inflatable lower beam 5 respectively communicated with an end of the first inflatable arcuate support member 21 and an end of the second inflatable arcuate support member 22. Preferably, an end of the inflatable top beam 4 is communicated with a vertex 26 of the first inflatable arcuate support member 21, the other end of the inflatable top beam 4 is communicated with a vertex 27 of the second inflatable arcuate support member 22, and a middle portion of the inflatable top beam 4 is communicated with a vertex 28 of the inflatable intermediate arcuate support member 23.

At least one valve is provided on at least one of the inflatable support members 21, 22, and 23 and the inflatable support beams 3*a*, 3*b*, 3*c*, 4, 5, and 6. In this embodiment, a valve 20 is provided on the inflatable intermediate arcuate support member 23. The canopy 1 is stretched by pumping air into the inflatable support members 21, 22, and 23 and inflatable support beams 3*a*, 3*b*, 3*c*, 4, 5, and 6 via the valve 20. Stakes 13 are then used to fix the corners 12 of the canopy 1 in place. A door 14 is defined in the front side of the canopy 1, and at least one window 15 is defined in one or two lateral sides of the canopy 1.

After inflation, the first and second inflatable arcuate support members 21 and 22 provide reliable support for the front and rear sides of the canopy 1, and the inflatable intermediate arcuate support member 23 provides reliable support for the intermediate portion of the canopy 1. Further, the inflatable support beams 3*a*, 3*b*, and 3*c* provide reliable support for the shoulder portion of the canopy 1, the inflatable lower beams 5 provide reliable support for the bottom of the canopy 1, and the inflatable top beam 4 and the inflatable reinforcing beams 6 provide reliable support for the upper portion of the canopy 1. Accordingly, the canopy 1 is quickly and reliably pitched and fixed, preventing the disadvantage of easy falling when subject to strong winds and/or heavy rains.

Figure 4:
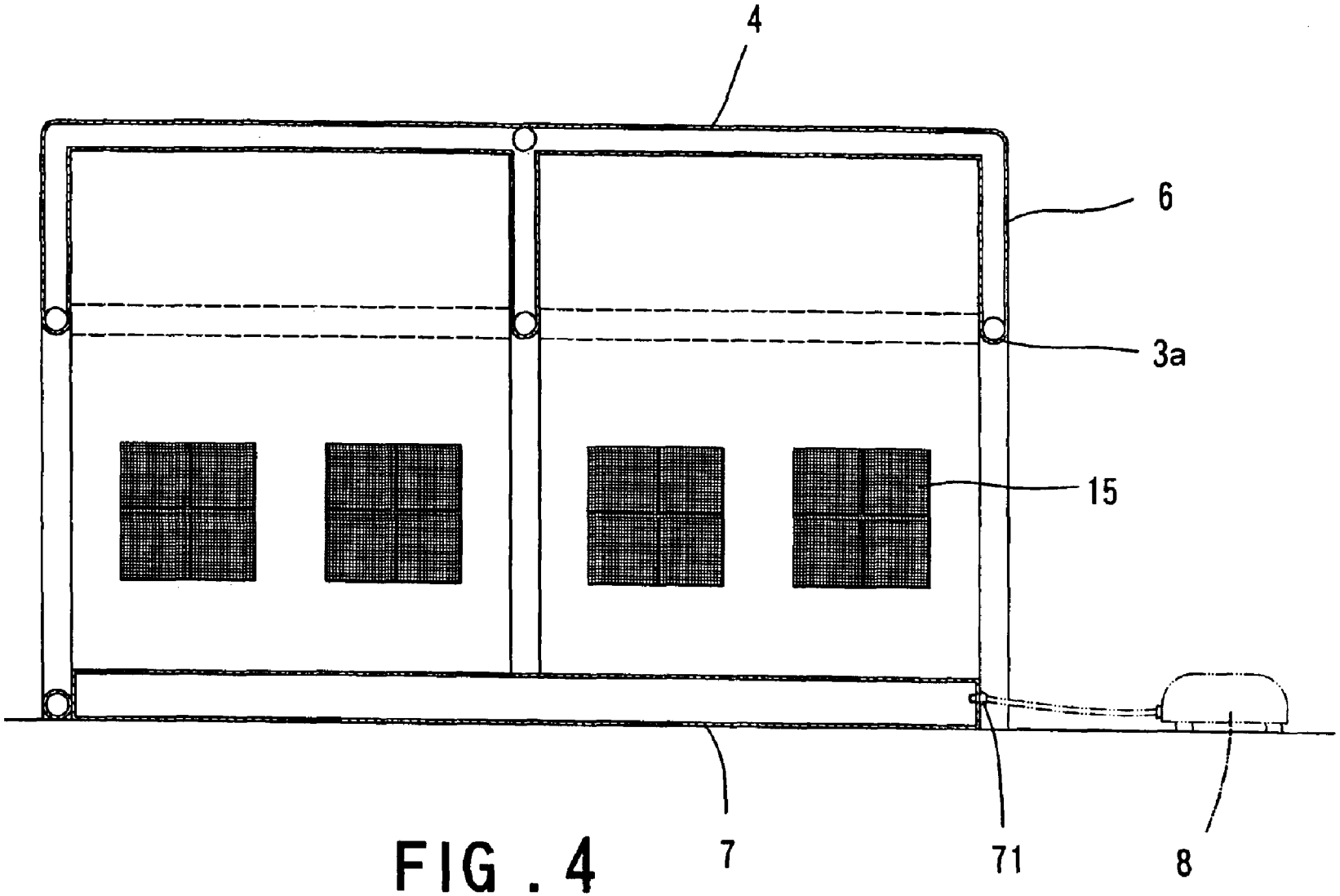
FIG. 4 is a sectional view taken along line 4—4 in FIG. 2.

Referring to FIG. 4, a mattress 7 can be mounted to the ground inside the canopy 1. A periphery of the mattress 7 may be connected to the lower periphery of the canopy 1. Further, the mattress 7 includes a valve 71, allowing air to be pumped by an air pump 8 into the mattress 7. Thus, comfortable sleep can be achieved. The air in the mattress 7 can be released when it is not time for sleep.

Figure 5:
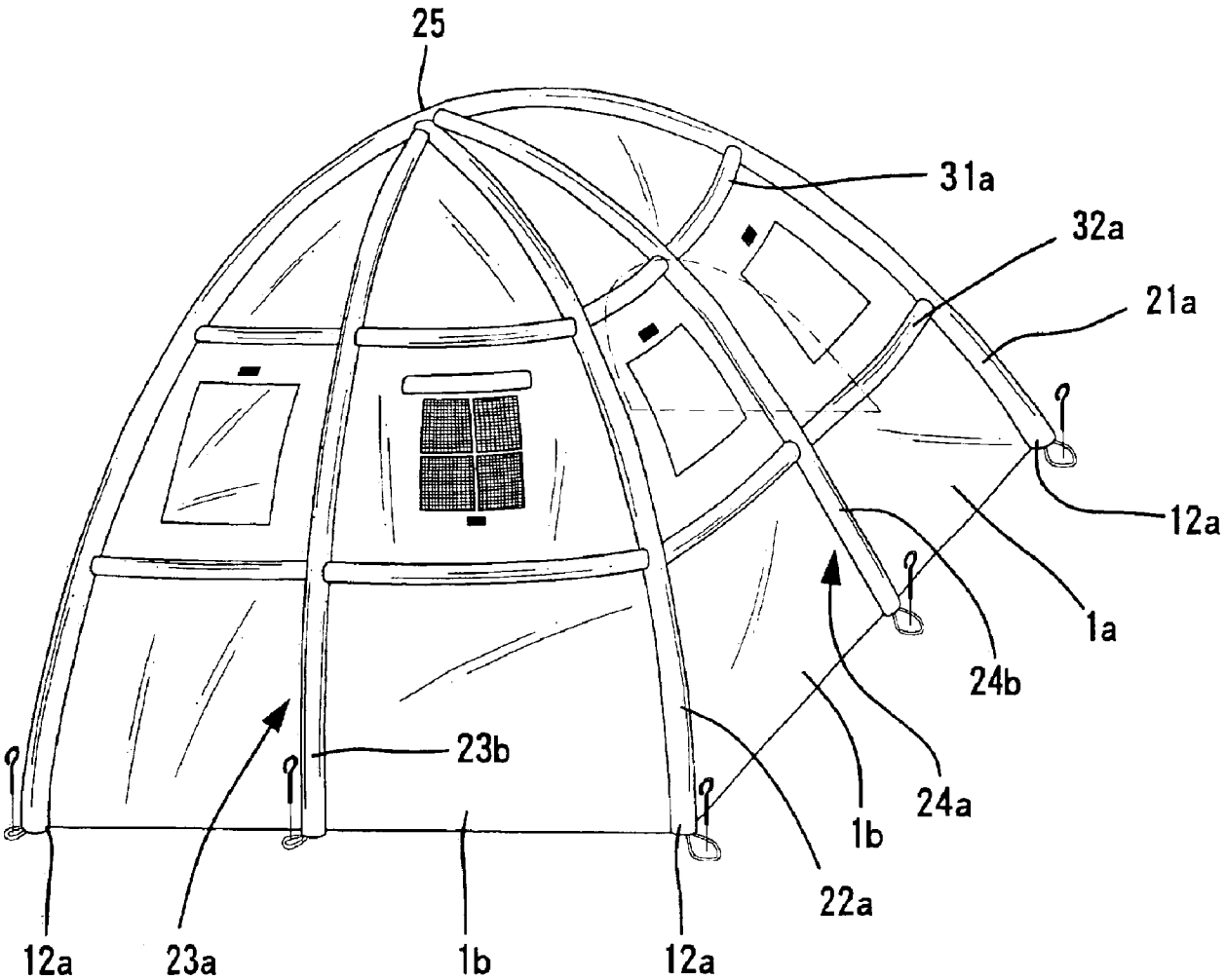
FIG. 5 is a perspective view of a second embodiment of the inflatable tent in accordance with the present invention.

FIG. 5 illustrates a second embodiment of the inflatable tent in accordance with the present invention. In this embodiment, the inflatable tent includes a canopy 1*a* and an inflatable main frame attached to the canopy 1*a*. The inflatable main frame includes first and second inflatable arcuate support members 21*a* and 22*a* that are crossed with each other. The first inflatable arcuate support member 21*a* has a first end located in a first one of four corners 12*a* of the canopy 1*a* and a second end located in a second one of the four corners 12*a* of the canopy 1*a*, wherein the first corner 12*a* is diagonally opposed to the second corner 12*a*. The second inflatable arcuate support member 22*a* has a first end located in a third one of the four corners 12*a* of the canopy 1*a* and a second end located in a fourth one of the four corners 12*a* of the canopy 1*a*, wherein the third corner 12*a* is diagonally opposed to and the fourth corner 12*a*.

Two inflatable intermediate arcuate support members 23*a* and 24*a* are attached to the canopy 1*a* and crossed with each other. Preferably, one of two sections 23*b*, 24*b* of each of the inflatable intermediate arcuate support members 23*a* and 24*a* lie in a middle portion of a respective one of four sectors 1*b* defined by the crossed first and second inflatable arcuate support members 21*a* and 22*a*. Preferably, the vertexes of the inflatable arcuate support members 21*a*, 22*a*, 23*a*, 24*a* meet at a common top point 25. Preferably, the inflatable arcuate support members 21*a*, 22*a*, 23*a*, and 24*a*, except the common top point 25, are spaced apart at regular angular intervals.

An upper inflatable support beam 31*a* is attached to and extends along an upper portion of the canopy 1*a* along a horizontal plane, and a lower inflatable support beam 32*a* is attached to and extends along a lower portion of the canopy 1*a* along another horizontal plane. Preferably, the upper inflatable support beam 31*a* is communicated with the inflatable arcuate support members 21*a*, 22*a*, 23*a*, and 24*a*. Preferably, the lower inflatable support beam 32*a* is communicated with the inflatable arcuate support members 21*a*, 22*a*, 23*a*, and 24*a*.

After inflation, the canopy 1*a* is uniformly supported by the inflatable arcuate support members 21*a*, 22*a*, 23*a*, and 24*a* and the inflatable support beams 31*a* and 32*a*. Thus, the canopy 1*a* is quickly and reliably pitched and fixed, preventing the disadvantage of easy falling when subject to strong winds and/or heavy rains.

Although not specifically shown in FIG. 5, the inflatable tent of the second embodiment may include an inflatable mattress on the ground inside the inflatable tent and at least one lower inflatable beam that are identical to those of the first embodiment.

Although the invention has been explained in relation to its preferred embodiment, it is to be understood that many other possible modifications and variations can be made without departing from the scope of the invention as hereinafter claimed.

What is claimed is:

1. An inflatable tent comprising:

a canopy having four corners;

an inflatable main frame including a first inflatable arcuate support member attached to the canopy and a second inflatable arcuate support member attached to the canopy, the first inflatable arcuate support member having a first end located in a first one of the four corners and a second end located in a second one of the four corners, the second inflatable arcuate support member having a first end located in a third one of the four corners and a second end located in a fourth one of the four corners;

at least one inflatable intermediate arcuate support member attached to the canopy and located between the first inflatable arcuate support member and the second inflatable arcuate support member, the first end and the second end of the first inflatable arcuate support member are located in a front side of the canopy, and the first end and the second inflatable arcuate support member being located in a rear side of the canopy;

an inflatable front support beam attached to the front side of the canopy, the inflatable front support beam having two ends respectively attached to two points of the first inflatable arcuate support member; and a plurality of reinforcing support beams attached to the front side of the canopy and located between the first inflatable arcuate support member and the inflatable front support beam.

2. The inflatable tent as claimed in claim 1, wherein said at least one intermediate arcuate support member extends on a plane parallel to the front side and the rear side of the canopy.

3. The inflatable tent as claimed in claim 2, further including an inflatable support beam attached to a top of the canopy and having a first end communicated with a vertex of the first inflatable arcuate support member and a second end communicated with a vertex of the second inflatable arcuate support member.

4. The inflatable tent as claimed in claim 3, wherein a middle portion of the inflatable top beam is communicated with a vertex of said at least one inflatable intermediate arcuate support member.

5. The inflatable tent as claimed in claim 1, further including an inflatable support beam attached to a top of the canopy and having a first end communicated with a vertex of the first inflatable arcuate support member and a second end communicated with a vertex of the second inflatable arcuate support member.

6. The inflatable tent as claimed in claim 1, wherein each said reinforcing support beam has an upper end communicated with an arcuate top portion of the first inflatable arcuate support member.

7. The inflatable tent as claimed in claim 1, further including two inflatable lateral support beams attached to two lateral sides of the canopy, each said inflatable lateral support beam having a first end communicated with the first inflatable arcuate support member and a second end communicated with the second arcuate support member.

8. The inflatable tent as claimed in claim 1, further including two lower beams attached to lower edges of two lateral sides of the canopy, each said lower beam having a first end communicated with the first inflatable arcuate support member and a second end communicated with the second inflatable arcuate support member.

9. The inflatable tent as claimed in claim 1, further including an inflatable mattress mounted to a ground inside the canopy, the inflatable mattress having a periphery connected to a lower periphery of the canopy.

10. An inflatable tent comprising:

a canopy having four corners;

an inflatable main frame including a first inflatable arcuate support member attached to the canopy and a second inflatable arcuate support member attached to the canopy, the first inflatable arcuate support member having a first end located in a first one of the four corners and a second end located in a second one of the four corners, the second inflatable arcuate support member having a first end located in a third one of the four corners and a second end located in a fourth one of the four corners;

at least one inflatable intermediate arcuate support member attached to the canopy and located between the first inflatable arcuate support member and the second inflatable arcuate support member, the first end and the second end of the first inflatable arcuate support member are located in a front side of the canopy, and the first end and the second end of the second inflatable arcuate support member being located in a rear side of the canopy;

an inflatable rear support beam attached to the rear side of the canopy, the inflatable rear support beam having two ends respectively attached to two points of the second inflatable arcuate support member; and a plurality of reinforcing support beams attached to the rear side of the canopy and located between the second inflatable arcuate support member and the inflatable rear support beam.

11. The inflatable tent as claimed in claim 10, wherein each said reinforcing support beam has an upper end communicated with an arcuate top portion of the second inflatable arcuate support member.

12. The inflatable tent as claimed in claim 10, wherein said at least one intermediate arcuate support member extends on a plane parallel to the front side and the rear side of the canopy.

13. The inflatable tent as claimed in claim 12, further including an inflatable support beam attached to a top of the canopy and having a first end communicated with a vertex of the first inflatable arcuate support member and a second end communicated with a vertex of the second inflatable arcuate support member.

14. The inflatable tent as claimed in claim 13, wherein a middle portion of the inflatable top beam is communicated with a vertex of said at least one inflatable intermediate arcuate support member.

15. The inflatable tent as claimed in claim 10, further including an inflatable support beam attached to a top of the canopy and having a first end communicated with a vertex of the first inflatable arcuate support member and a second end communicated with a vertex of the second inflatable arcuate support member.

16. The inflatable tent as claimed in claim 10, further including two inflatable lateral support beams attached to two lateral sides of the canopy, each said inflatable lateral support beam having a first end communicated with the first inflatable arcuate support member and a second end communicated with the second arcuate support member.

17. The inflatable tent as claimed in claim 10, further including two lower beams attached to lower edges of two lateral sides of the canopy, each said lower beam having a first end communicated with the first inflatable arcuate support member and a second end communicated with the second inflatable arcuate support member.

18. The inflatable tent as claimed in claim 10, further including an inflatable mattress mounted to a ground inside the canopy, the inflatable mattress having a periphery connected to a lower periphery of the canopy.

* * * * *